US006183574B1

(12) United States Patent
Warren

(10) Patent No.: US 6,183,574 B1
(45) Date of Patent: Feb. 6, 2001

(54) PROCESSING PROCEDURE FOR ISOCYANATE CURED PROPELLANTS CONTAINING SOME BISMUTH COMPOUNDS

(75) Inventor: Larry C. Warren, Huntsville, AL (US)

(73) Assignee: The United States of America as represented by the Secretary of the Army, Washington, DC (US)

( * ) Notice: Under 35 U.S.C. 154(b), the term of this patent shall be extended for 0 days.

(21) Appl. No.: 09/393,065

(22) Filed: Sep. 2, 1999

(51) Int. Cl.[7] ..... D03D 23/00; C06B 45/10
(52) U.S. Cl. ..... 149/109.6; 149/19.2; 264/3.1
(58) Field of Search ..... 149/109.6, 19.92; 264/3.1

(56) References Cited

U.S. PATENT DOCUMENTS 4,379,903 * 4/1983 Reed, Jr. et al. ..... 528/55
4,389,263 * 6/1983 Allen ..... 149/11
4,517,035 * 5/1985 Duchesne et al. ..... 149/19.92
4,597,811 * 7/1986 Ducote ..... 149/19.92
4,775,432 * 10/1988 Kolonko et al. ..... 149/19.4
4,803,019 * 2/1989 Graham et al. ..... 264/3.1
4,915,755 * 4/1990 Kim ..... 149/19.4
5,031,539 * 7/1991 Hutchens ..... 102/290
5,398,612 * 3/1995 Graham et al. ..... 102/287
5,468,313 * 11/1995 Wallace, II et al. ..... 149/53
5,500,061 * 3/1996 Warren et al. ..... 149/19.4
5,639,987 * 6/1997 Berteleau et al. ..... 149/19.8

* cited by examiner

*Primary Examiner*—Charles T. Jordan
*Assistant Examiner*—Glenda L. Sanchez
(74) *Attorney, Agent, or Firm*—Arthur H. Tischer; Freddie M. Bush

(57) ABSTRACT

A processing procedure for incorporating bismuth compounds into isocyanate cured hydroxy terminated binder propellants has been discovered. When added to the propellant formulation in ballistic modifier amounts (≧0.25%), bismuth salicylate and bismuth β-resorcylate significantly reduce the potlife to less than 1-hour. It was discovered that to maximize propellant potlife the temperature of the mixture at the time of the addition is critically important. The potlife of propellants containing bismuth compounds can be increased to greater than 15 hours at 70° F., when the temperature of the mixture at the addition step for bismuth, is lowered from the normal addition temperature of 150° F., to 60° F. Depending on the formulation and solids loading, the viscosity of the propellant at 60° F. is not greatly affected.

2 Claims, 1 Drawing Sheet

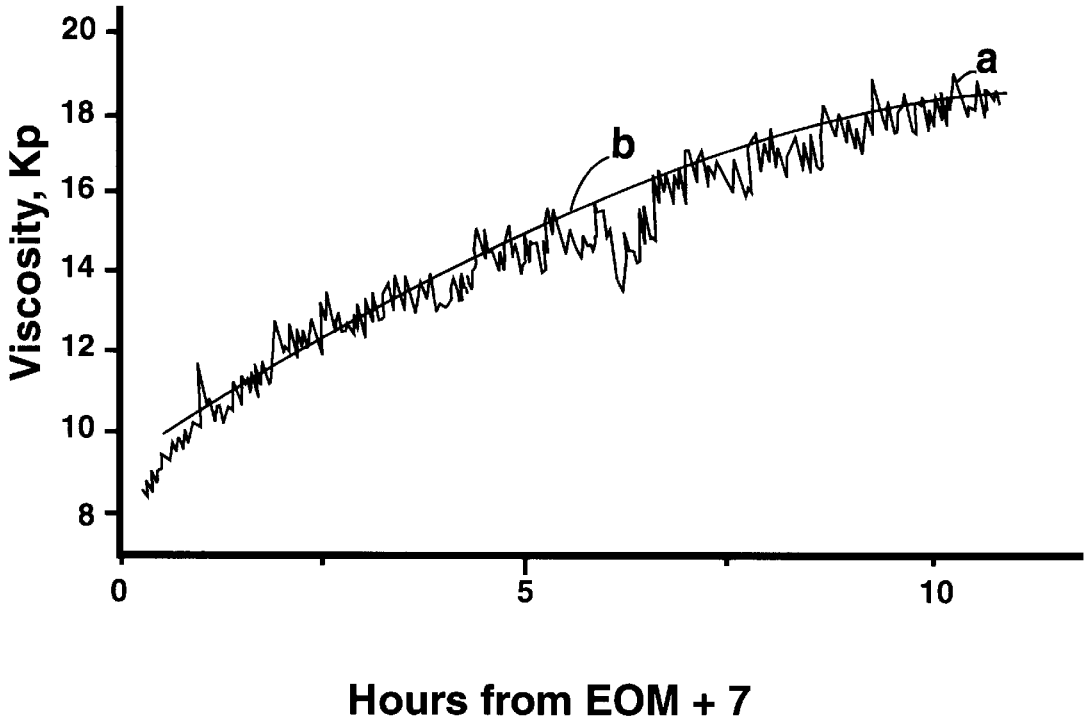
Viscosity, Kp
20
18
16
14
12
10
8
0
5
10
a
b
Hours from EOM + 7

PROCESSING PROCEDURE FOR ISOCYANATE CURED PROPELLANTS CONTAINING SOME BISMUTH COMPOUNDS

DEDICATORY CLAUSE

The invention described herein may be manufactured, used and licensed by or for the Government for governmental purposes without the payment to me of any royalties thereon.

BACKGROUND OF THE INVENTION

Bismuth compounds have been used extensively as cure catalysts for isocyanate cured hydroxy terminated propellant binder systems. The most widely used of these bismuth compounds is triphenylbismuth (TPB). Triphenylbismuth is used in very small quantities, usually less than 0.03 percent by weight in the propellant formulation. There are no ballistics additive effects gained when this small amount is used.

Two bismuth compounds, bismuth salicylate(BS) and bismuth β-resorcylate(Bβ-R), have been identified to be effective as ballistic modifiers in minimum signature propellants(see Table I). These compounds are the salts of their corresponding organic acids, salicylic and β-resorcylic acids, respectively (see Table II). The ballistic modification properties of these bismuth compounds in minimum signature propellants were determined to be comparable to results obtained with similar lead compounds, lead salicylate and lead β-resorcylate. Lead salicylate and lead β-resorcylate are widely used as ballistic modifiers in some minimum signature Army tactical missile propellants.

Because of the toxic properties of lead compounds, Environmental Protection Agency requirements to eliminate lead from Army propulsion systems have fueled research activities to find alternatives. Bismuth compounds were evaluated as replacements for lead. Initial results were promising. The ballistic properties of the bismuth compounds in similar propellant formulations were comparable to lead compounds. However, researchers suspected and later confirmed that the bismuth compounds would cause a significant decrease in propellant potlife by prematurely catalyzing the propellant hydroxy/isocyanate cure reaction. Because of the significant reduction in propellant potlife caused by the bismuth compounds, research evaluating bismuth compounds as replacements was quickly curtailed.

Bismuth compounds tend to reduce the potlife of propellants to less than 1-hour, when used in quantities in excess of one tenth percent by weight in propellant formulations. A desirable potlife for castable solid propellants is 4–10 hours. Potlife can be defined as the time it takes for the viscosity of the propellant to increase to forty kilopoise(kp) after the addition of the curing agent. A viscosity of forty kp is generally considered the maximum where proper casting or loading of the propellant into motors can be achieved. Proper casting occurs when no voids or unfilled spaces are created in the propellant due to air being present during the cure reaction. These void formations are undesirable because they cause ballistic and/or mechanical anomalies.

Table I, Table II, and Table III, all set forth hereinbelow, show typical minimum signature propellant formulation, bismuth ballistic modifiers, and general propellant mixing procedure for minimum signature propellants, respectively. The typical mixing procedure (see Table III) used in formulating minimum signature propellants is to add all liquids, and then all the solids in increments. The mixture is then mixed at 150° F. under vacuum, for some set period of time to rid the mixture of any volatile components. The mixture is then cooled to 90–100° F., before the curing agent is added. When bismuth compounds are added at Step 2, the maximum potlife is less than 1-hour. Sometimes the mixture cures during the first 10-minutes after Step 6. With ballistic modifier addition at Step 2, cooling the mixture to less than 70° F. only slightly increased the potlife to approximately 1-hour. Eliminating the dibutyltin cure catalyst in step 6 only increased the potlife to nearly 2-hours. When the addition of the bismuth was delayed until Step 4, only an additional slight improvement in the potlife to less than 3-hours was achieved. By reviewing these tables one should more fully appreciate the novelty of the improved processing procedure set forth later in Table IV.

TABLE I

Typical Minimum Signature Propellant Formulation

| Ingredients | % by weight |
|---|---|
| POLYMER | 7.50 |
| BTTN | 16.41 |
| TMETN | 7.03 |
| OXIDIZER | 62.75 |
| MNA | 0.50 |
| CARBON | 0.50 |
| Ballistic additive | 4.00 |
| N100 | 1.31 |
| Total | 100.00 |

NOTE: OXIDIZER(S) = RDX,HMX, AMMONIUM NITRATE
CATALYSTS = BISMUTH COMPOUNDS, ZrC
POLYMER(S) = ORP-2,PGA, CAPROLACTONES, etc.

TABLE II

Bismuth ballistic modifiers

| | |
|---|---|
| Salicylic acid, | $C_7H_6O_3$ |
| Bismuth salicylate, | $C_7H_5O_3Bi$ |
| β-Resorcylic acid, | $C_7H_6O_4$ |
| Bismuth β-Resorcylate, | $C_7H_5O_4Bi$ |

TABLE III

General Propellant mixing procedure for minimum signature propellants

| | |
|---|---|
| Step 1. | Weigh polymer, plasticizer(s), carbon, add to mixer(preheated to 150° F.) |
| Step 2. | Add oxidizer(s), ballistic modifiers(bismuth, ZrC) |
| Step 3. | Mix under vacuum at 150° F. for 2-hours |
| Step 4. | Cool to 90–100° F. |
| Step 5. | Add MNA |
| Step 6. | Add curing agent, cure catalyst, Mix additional 20 minutes |
| Step 7. | Cast in container(s) |
| Step 8. | Place in cure oven @ 140° F. for 7 days |
| Step 9. | Tests/evaluations |

An object of this invention is to provide a procedure for processing isocyanate cured minimum signature propellants containing bismuth compounds as ballistic additives that will result in an adequate potlife for casting propellants into the desired missile configurations. When the proper processing procedure is used, adequate propellant potlife is achieved.

SUMMARY OF INVENTION

Bismuth compounds, such as bismuth salicylate and bismuth β-resorcylate, can be used as ballistic modifiers in isocyanate cured hydroxy-terminated propellant binder systems when the processing procedure is changed to delay the catalytic effects of the bismuth on the binder/cure agent reaction. Thus, the mixing procedure set forth in Table IV below depicts the preferred embodiment for obtaining a potlife of greater than 15 hours.

BRIEF DESCRIPTION OF THE DRAWING

The FIGURE of Drawing represents potlife values in hours from end of mix plus 7 hours wherein many data points for viscosity are depicted as read by a computer at ambient temperature.

DESCRIPTION OF PREFERRED EMBODIMENT

A representative propellant formulation used in these determinations is as described in Table V. The procedure for processing isocyanate cured minimum signature propellants containing bismuth salicylate and or the equivalent amount of bismuth β-resorcylate to achieve maximum potlife, is changed to give a propellant potlife in excess of 15 hours at 70° F. When the addition of the bismuth compounds is delayed to Step 5 of Table IV, a significant and an unexpected increase in the potlife is achieved. It is believed that at 60° F. the formation of bismuth ions within the liquid propellant matrix is significantly delayed thus delaying the catalytic effect on the cure reaction. When the propellant mixture was maintained at 60° F., the cure reaction did not occur overnight. The results from the potlife determination are shown in the FIGURE of the Drawing. Both the Step and temperature at which the bismuth compounds are added determine the potlife after the addition of the curing agent. In further reference to potlife values shown in FIGURE of the drawing, a plurality of data points are shown (wherein one such data point is depicted as "a"); and line "b" represents the best fit for all data points. The binder (polymer+plasticizer+curing agent) percent can vary to obtain optimum propellant mechanical properties and the desired performance. Also, the concentration of solids (oxidizers, catalysts) in mixture could reduce or increase the potlife since higher solids propellants are normally more viscous at the end of propellant mix cycle.

TABLE IV

Preferred mixing procedure of minimum signature propellants containing bismuth compounds.

| | |
|---|---|
| Step 1. | Weigh polymer(s), plasticizer(s), carbon, add to mixer |
| Step 2. | Add oxidizer(s) |
| Step 3. | Mix under vacuum at 150° F. for 2-hours |
| Step 4. | Cool mixture to 60° F. |
| Step 5. | Add MNA; add ballistic modifiers, mix under vacuum for 10 minutes |
| Step 6. | Add curing agent, mix additional 20 minutes |
| Step 7. | Cast in container(s) |
| Step 8. | Place in cure oven @ 140° F. for 7 days |
| Step 9. | Tests/evaluations |

TABLE V

Propellant formulation used in this evaluation

| Ingredient* | | % by weight |
|---|---|---|
| ORP-2 | (energetic nitramine polymer) | 7.50 |
| BTTN | (butanetriol trinitrate-plasticizer) | 20.87 |
| TMETN | (trimethylolethane trinitrate-plasticizer) | 8.95 |
| A1120 | (amine bonding agent) | 0.25 |
| CARBON | (carbon black) | 0.25 |
| AN | (permalene ammonium nitrate-oxidizer) | 28.00 |
| HMX | (tetramethylene tetranitramine) | 28.00 |
| BiSalicylate | (bismuth salicylate) | 2.00 |
| ZrC | (zirconium carbide-ballistic stabilizer) | 2.00 |
| MNA | (N-methyl para nitroaniline-chemical aging stabilizer) | 0.50 |

TABLE V-continued

Propellant formulation used in this evaluation

| Ingredient* | | % by weight |
|---|---|---|
| N100 | (triisocyanate, curing agent) | 1.68 |
| | Total | 100.00 |

*See ingredients further defined below in Table V: Ingredients Defined.

TABLE V

Ingredients Defined

| | |
|---|---|
| A1120 | amine bonding agent |
| AN | permalene ammonium nitrate-oxidizer |
| ORP-2 | energetic nitramine polymer, developed by Olin Corporation |
| BTTN | butanetriol trinitrate-plasticizer |
| CARBON | carbon black |
| Ballistic- modifiers: | bismuth compounds-bismuth salicylate and bismuth β-resorcylate |
| HMX | tetramethylene tetranitramine |
| MNA | N-methyl para nitroaniline-chemical aging stabilizer |
| N100 | triisocyanate, curing agent |
| ORP-2 | energetic nitramine polymer |
| Oxidizer(s) | AN, HMX, RDX |
| RDX | trimethylene trinitramine |
| TMETN | trimethylolethane trinitrate-plasticizer |
| ZrC | zirconium carbide-ballistic stabilizer |

I claim:

1. A processing procedure for achieving an extended potlife for isocyanate cured minimum smoke propellants containing bismuth compounds and other ingredients comprising polymers, plasticizer(s), carbon, oxidizer(s), ballistic modifiers, chemical aging stabilizer, curing agent, and cure catalyst, said processing procedure comprising completing the steps 1–8 as follows:

step 1: weigh polymer, plasticizer(s), and carbon and add to mixer preheated to 150° F.;

step 2: add oxidizer(s);

step 3: mix under vacuum at 150° F. for 2 hours;

step 4: cool to 60° F.;

step 5: add chemical aging stabilizer, ballistic modifiers, mix under vacuum for 10 minutes;

step 6: add curing agent, cure catalyst, and mix an additional 20 minutes;

step 7: cast propellant in containers; and, step 8: place container containing propellant in oven at 140° F. for 7 days.

2. The processing procedure for achieving an extended potlife for isocyanate cured minimum smoke propellants containing bismuth compounds as defined in claim 1 wherein said potlife is extended to greater than 15 hours when a test propellant is processed in accordance with claim 1, steps 1–8, said test propellant comprising the ingredients in percent by weight amounts as follows: energetic nitramine polymer, 7.5; butanetriol trinitrate-plasticizer, 20.87; trimethylolethane trinitrate-plasticizer, 8.95; amine bonding agent, 0.25; carbon black, 0.25; permalene ammonium nitrate-oxidizer, 28.00; tetramethylene tetranitramine, 28.00; bismuth salicylate, 2.00, or the equivalent amount of bismuth β-resorcyclate; zirconium carbide-ballistic stabilizer, 2.00; N-methyl para nitroaniline-chemical aging stabilizer, 0.50; and triisocyanate, curing agent, 1.68.

* * * * *